US007290981B2

(12) United States Patent
Guzorek

(10) Patent No.: US 7,290,981 B2
(45) Date of Patent: Nov. 6, 2007

(54) INLINE VENT FAN

(75) Inventor: Steven E. Guzorek, Kinston, NC (US)

(73) Assignee: Field Controls, LLC, Kinston, NC (US)

( * ) Notice: Subject to any disclaimer, the term of this patent is extended or adjusted under 35 U.S.C. 154(b) by 137 days.

(21) Appl. No.: 11/078,747

(22) Filed: Mar. 10, 2005

(65) Prior Publication Data

US 2006/0204358 A1 Sep. 14, 2006

(51) Int. Cl.
*F04D 15/00* (2006.01)
*F04D 29/00* (2006.01)

(52) U.S. Cl. ..... 415/151; 415/191; 415/206; 415/169.2; 415/214.1; 415/208.2

(58) Field of Classification Search ..... 415/191, 415/206, 208.2, 211.2, 214.1, 169.2, 151
See application file for complete search history.

(56) References Cited

U.S. PATENT DOCUMENTS

| | | | | |
|---|---|---|---|---|
| 886,268 | A | | 4/1908 | Stuart |
| 2,588,012 | A | | 3/1952 | Kirkpatrick |
| 2,617,371 | A | | 11/1952 | Resek et al. |
| 4,447,189 | A | * | 5/1984 | Jensen et al. ..... 415/169.1 |
| 4,750,433 | A | | 6/1988 | Guzorek |
| 5,030,061 | A | * | 7/1991 | Meissgeier ..... 415/203 |
| 5,385,444 | A | * | 1/1995 | Kobayashi et al. ..... 415/182.1 |

* cited by examiner

*Primary Examiner*—Ninh H. Nguyen
(74) *Attorney, Agent, or Firm*—Wood, Phillips, Katz, Clark & Mortimer

(57) ABSTRACT

A vent fan is for directing a fluid along a vent pipe. The vent fan has a housing defining an inlet, an outlet and an internal space for a fluid flow path. A separating wall divides the internal space into an inlet and outlet chamber. The vent fan also includes first and second baffles to block the fluid flow from traveling into the outlet and inlet chambers respectively. The separating wall may also include at least one fin for directing the fluid flow towards a first passageway.

25 Claims, 2 Drawing Sheets

INLINE VENT FAN

FIELD OF THE INVENTION

This invention relates to power vent fans, and in more particular applications, to inline powered vent fans.

BACKGROUND OF THE INVENTION

Devices for overcoming draft problems frequently associated with chimneys as well as vent systems having a motor-driven fan or other gas-propelling device are well known in the art and are classified as draft inducers. Also known in the art are powered vent fans having a motor-driven, centrifugal fan wheel in a housing that can be mounted in association with a vent pipe to create a mechanical draft, as may be required by new high-efficiency furnaces, unit heaters, and other fuel-burning appliances. The powered vent fan assures a constant, uninterrupted flow of draft and flue gases through the fuel-burning appliance and its vent system. Both draft inducers and powered vent fans have in common a housing and a motor-driven fan or blower wheel. Additionally, both draft inducers and powered vent fans operate by creating regions of respectively higher and lower pressures to cause fluid to flow towards or away from a specific appliance or unit.

An early example of a fan connectable into a flue pipe is shown in U.S. Pat. No. 886,268 wherein the fan is manually driven.

Other known prior art draft devices which may be mounted inline in a vent pipe of a vent system are shown in U.S. Pat. Nos. 2,588,012 and 2,617,371.

Inline vent fans typically allow for the inlet and outlet of the fan to be positioned along a common axis and therefore can be placed within an existing pipe, such as seen in U.S. Pat. No. 4,750,433. However, in some instances inserting vent fans into existing pipes can be costly, time consuming and connections therebetween may be prone to leaking. Additionally, the vent fan may not operate efficiently if the inlet and outlet are not sealed to prevent recirculation of the fluid because the distinct zones of respective positive and negative pressure become intermixed. Furthermore, such inline vent fans tend to lose efficiency due to drag and friction from within the fan itself as the fluid contact different parts and regions of the fan.

SUMMARY OF THE INVENTION

In accordance with one form of the invention, a powered vent fan is provided for directing a fluid along a vent pipe. The vent fan includes a housing defining an inlet, an outlet and an internal space through which a fluid moves along a flow path between the inlet and the outlet. A separating wall divides the internal space so as to define an inlet chamber and an outlet chamber. A first passageway communicates between the inlet chamber and the outlet chamber. The fluid in the flow path moves from the inlet to and through the inlet chamber, the first passageway, the outlet chamber and the outlet. The vent fan also includes at least one fin residing in the inlet chamber and intercepting, and directing the fluid flow from the inlet towards the first passageway. A first baffle surface extends transversely to the flow path and blocks the passage of the fluid at the inlet into the outlet chamber while a second baffle surface extends transversely to the flow path and blocks the passage of the fluid at the outlet back into the inlet chamber.

In accordance with one form, the vent fan includes a housing having an interior and an exterior. The interior has a first internal side and a second internal side substantially opposite the first internal side. The housing defines an inlet, an outlet and an internal space through which a fluid moves along a flow path between the inlet and the outlet. A separating wall divides the internal space so as to define an inlet chamber and an outlet chamber. A first passageway communicates between the inlet chamber and the outlet chamber. The fluid in the flow path moves from the inlet to and through the inlet chamber, the first passageway, the outlet chamber and the outlet. The vent fan also includes at least one fin residing in the inlet chamber and intercepting, and directing the fluid flow from the inlet towards the first passageway. A first baffle surface is formed as one piece with the first internal side and extends transversely to the flow path and blocks the passage of the fluid at the inlet into the outlet chamber while a second baffle surface is formed as one piece with the second internal side and extends transversely to the flow path and blocks the passage of the fluid at the outlet back into the inlet chamber.

In one form, the vent fan includes a housing defining an inlet for directing a fluid along a first axis into an interior of the housing, an outlet for discharging the fluid out of the interior of the housing substantially along the first axis and an internal space through which the fluid moves along a flow path between the inlet and outlet. A separating wall divides the internal space so as to define an inlet chamber and an outlet chamber. A first passageway communicates between the inlet chamber and the outlet chamber. The fluid in the flow path moves from the inlet to and through the inlet chamber, the first passageway, the outlet chamber and the outlet. The vent fan also includes at least one fin residing in the inlet chamber and intercepting, and directing the fluid flow from the inlet towards the first passageway.

In one form, the vent fan includes at least one condensate port on the housing for draining condensate from the vent fan.

According to one form, the housing comprises of two joinable halves.

In accordance with one form, the inlet and outlet are aligned along a common axis.

In one form, the at least one fin projects from the separating wall.

According to one form, the fin extends perpendicularly from the separating wall.

In accordance with one form, the separating wall includes a curved trailing edge.

According to one form, the curved trailing edge contacts the second baffle.

In one form, the separating wall is formed as one piece with the housing.

In accordance with one form, the vent fan includes a flow restricter to control the flow rate of the fluid.

According to one form, the flow restricter has a curved plate.

In accordance with one form, the flow restricter has a controller located external to the housing for controlling the flow restricter.

According to one form, the first passageway is aligned along a passage axis located coaxially with the first passage.

According to one form, the flow restricter pivots about the passage axis.

Other objects, advantages, and features will become apparent from a complete review of the entire specification, including the appended claims and drawings.

DETAILED DESCRIPTION OF THE PREFERRED EMBODIMENTS

Figure 1:
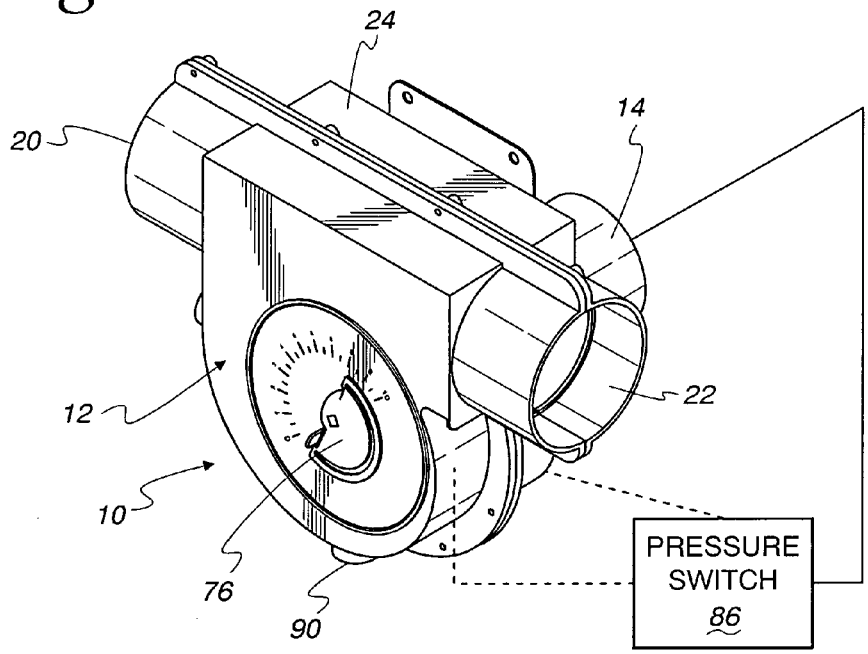
FIG. 1 is a perspective view of a powered vent fan.

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Figure 2:
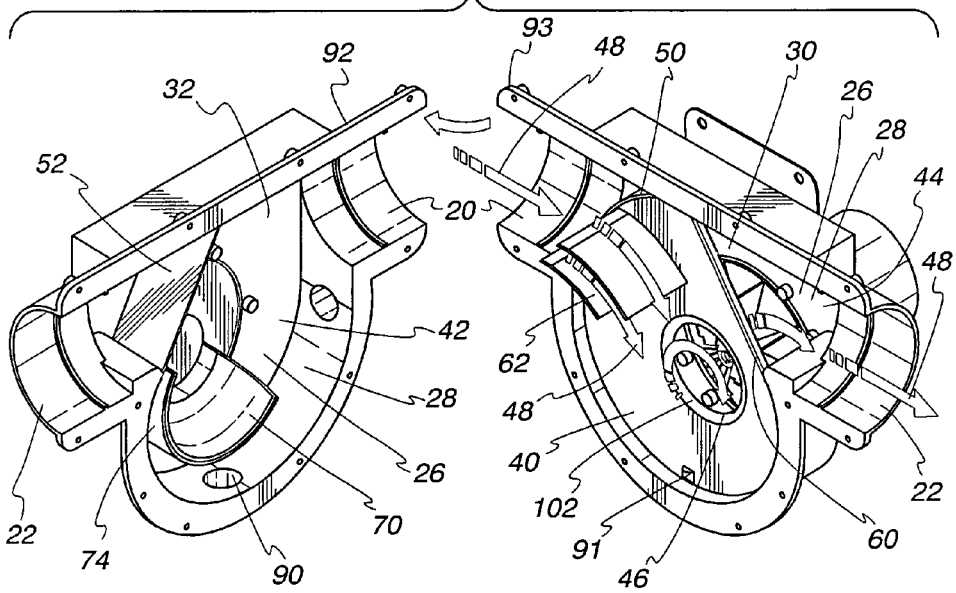
FIG. 2 is a perspective exploded view of the vent fan of FIG. 1.
Figure 3:
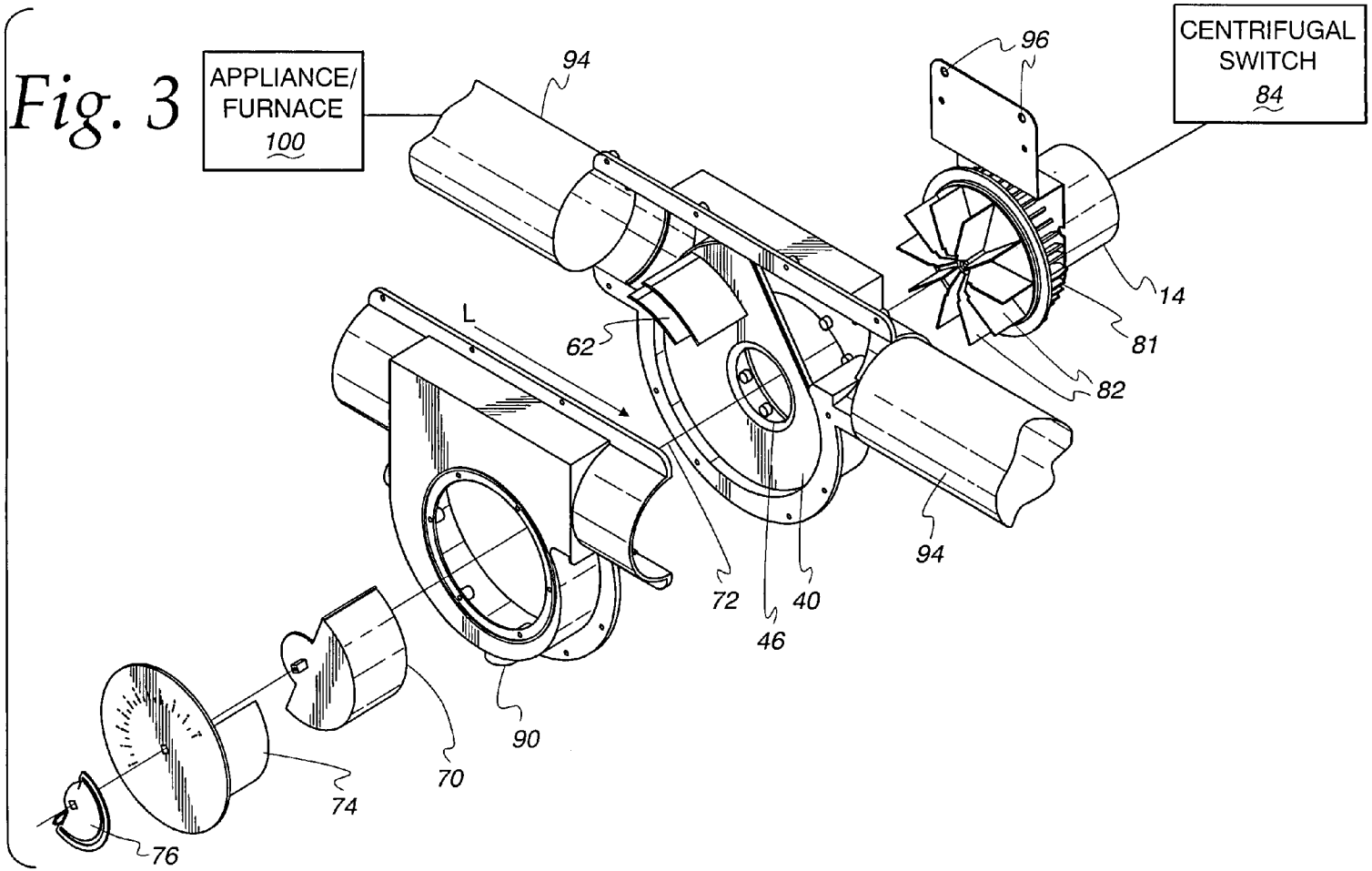
FIG. 3 is an exploded view of the assembly of the vent fan around a pipe.

A powered vent fan 1 is shown in FIGS. 1-3. The powered vent fan 10 includes a housing 12 and a motor 14 for drawing a fluid into, and propelling fluid from, the housing 12. The housing 12 defines an inlet 20 and an outlet 22. The housing 12 has an exterior 24 and an interior 26. An internal space 28 on the interior 26 is bounded by a first internal side 30 and a second internal side 32. The first internal side 30 is located on opposite sides of a flow line L through the inlet 20 and outlet 22 relative to the second internal side 32.

The vent fan 10 also includes a separating wall 40 which divides the internal space 28 to define an inlet chamber 42 and an outlet chamber 44. As seen in FIG. 2, the vent fan 10 includes a first passageway 46 between the inlet chamber 42 and the outlet chamber 44. The first passageway allows fluid to travel between the inlet chamber 42 and the outlet chamber 44. Fluid flows along a path, as indicated by arrows 48, from the inlet 20 and to and through the inlet chamber 42, the first passageway 46, the outlet chamber 44 and the outlet 22.

Further, the vent fan 10 includes a first baffle surface 50 that extends transversely to the flow path 48 and blocks the passage of fluid at the inlet 20 from entering into the outlet chamber 44. Additionally, the vent fan 10 includes a second baffle surface 52 that extends transversely to the flow path 48 and blocks the passage of fluid at the outlet 22 from entering back into the inlet chamber 42.

The baffles 50,52 are shaped and positioned such that they interact with the separating wall 40 to separate the inlet chamber 42 from the outlet chamber 44. The edges of the separating wall 40 can be adapted to contact the baffles 50,52 to create a substantially fluid tight seal. The baffles 50,52 may be attached to the first and second internal sides 30,32 respectively. Alternatively, the baffles 50,52 may be made as a single unitary piece with the respective internal sides 30,32. The baffles 50,52 prevent the fluid flow from crossing over between the inlet and outlet chambers 42,44 at undesired locations. Furthermore, the shape of the baffles 50,52 helps direct the fluid flow through the fluid flow path 48. Specifically the baffles 50,52 are curved such that they aid in the flow of fluid entering and exiting from the vent fan 10.

Additionally, the separating wall 40 has a curved trailing edge 60. The curved trailing edge 60 can be used to contact one of the baffles 50,52, such as the second baffle 52. The separating plate 40 has one or more fins 62. As seen in FIG. 3, the fins 62 extend substantially perpendicularly from a flat surface on the separating plate 40. The fins 62 are situated to intercept flow adjacent to the inlet 20 as it enters the inlet chamber 42 and are spaced radially relative to the axis of the first passageway 46 to a substantial distance outside the diameter thereof. Additionally, the fins 62 are curved to help direct the fluid flow in the inlet chamber 42. While the separating wall 40 is shown in FIG. 2 as a separate component in the vent fan 10, it should be readily understood that the separating wall 40 may also be formed as a single piece with the housing 12 or with one of the first or second internal sides 30,32. The separating wall 40 may be a separate piece from the housing or integral with the housing to facilitate ease of assembly and/or installation.

The vent fan 10 also includes a flow restricter 70. As seen in FIG. 3, the first passageway 46 is aligned along an axis 72 that is substantially orthogonal to the flow line L. The flow restricter 70 has a curved plate that pivots about the axis 72 without moving axially. The flow restricter 70 also interacts with a fixed restricter plate 74. Furthermore, the vent fan 10 has an external controller 76, such as seen in FIG. 3.

The external controller 76 is operably coupled to the flow restricter 70 such that when the external controller 76 is rotated, the flow restricter 70 is also rotated. The external controller 76 is located so that is may be manually grasped and turned by an operator or automatically adjusted by mechanized means (not shown). As the flow restricter 70 is turned, it interacts with the fixed restricter plate 74 to limit the fluid flow through the first passageway 46. The flow restricter 70 and/or the fixed restricter plate 74 has a radially facing surface(s) that blocks passage of flow from the inlet chamber 42 into the first passageway 46. In one embodiment, the flow restricter 70 and the fixed restricter plate 74 can be relatively positioned to completely close off the first passageway and prevent any substantial fluid flow from entering the first passageway 46. In another embodiment, the flow restricter 70 and the fixed restricter plate 74 are sized and shaped such that the first passageway 46 is never completely blocked from the fluid flow. It should be understood by those skilled in the art that the size and shape of the flow restricter 70 and the fixed restricter plate 74 may be selected in any appropriate manner to adjust for the size of the first passageway 46 and also to allow for or prevent completely closing off of the first passageway 46 from the inlet chamber 42.

The vent fan 10 also includes a impeller 81 with a plurality of vanes 82 rotated by the motor 14. The motor 14 has a central shaft (not shown) that is operably coupled to the impeller 81. The vanes 82 are located within the outlet chamber 44. When the motor 14 is powered, it rotates the central shaft and connected impeller 81. As the vanes 82 rotate, they create a positive pressure region and propel the fluid flow out of the outlet chamber 44 through the outlet 22, which has a negative pressure with respect to the outlet chamber 44. Consequently, as the vanes 82 propel the fluid from the outlet chamber 44, additional fluid flow will be induced between the inlet chamber 42 and the outlet chamber 44. Therefore, the vanes 82 cause the fluid to travel from the inlet 20 through the inlet and outlet chambers 42 and 44, past the vanes 82 and subsequently exit through the outlet 22.

As seen in FIG. 3, the vent fan 10 includes a centrifugal switch 84. The centrifugal switch 84 may act to shut off the motor 14 if the motor 14 is operating at an inappropriate speed, i.e. too slowly. Additionally, the switch 84 may operate as a safety switch in response to any number of different signals, such as a pressure signal, torque signal, a manually operated signal, or any other signal known in the art.

As seen in FIG. 1, the vent fan 10 includes a pressure switch 86. The pressure switch 86 may be located internally or externally to the inlet and outlet chambers 42,44. Additionally, the pressure switch 86 may be operably coupled to both the inlet and outlet chambers 42,44 to provide a pressure differential. The pressure switch 86 may be connected directly or indirectly to the motor 14 or the power source (not shown) for the motor 14. The pressure switch 86 can be designed such that it will shut down the vent fan 10 if a pre-set condition, such as a maximum or minimum pressure or pressure differential, is satisfied.

The vent fan 10 may also include condensate ports 90 located on the housing 12. As the fluid flow travels through the vent fan 10, the vapor in the fluid may begin to condense within the vent fan 10 due to pressure and temperature changes. If sufficient vapor condenses, it may accumulate in the housing 12, including the inlet and outlet chambers 42,44 and the first passageway 46, to modify the volume and shape of the path 48. Therefore, the vent fan 10 includes one or more of the condensate ports 90 to allow the condensation to be removed from the vent fan 10. The condensate ports 90 may be located at the inlet and/or outlet chambers 42,44. Additionally, the condensate ports 90 may be located at the bottom of the housing 12 if the vent fan 10 is horizontally oriented as in the Figures herein. If the vent fan 10 is inclined from horizontal, the condensate ports may be located at other regions on the housing to facilitate removal of the condensation as understood by those skilled in the art. The vent fan 10 may also include a bypass 91 in the separating wall 40. The bypass 91 allows any condensation to travel between the inlet and outlet chambers 42,44 to exit the vent fan via the condensate port 90.

As shown in FIG. 2, the housing 12 has two joinable portions 92,93. In one embodiment, the joinable portions 92,93 are joinable halves. However, it should be understood by those skilled in the art that the relative sizes and shapes of the portions 92,93 may be varied as desired.

With joinable portions 92,93 the vent fan 10 can be readily assembled around cut portions of tubes or pipes 94. Specifically, instead of inserting the vent fan 10 into a small cut portion (not shown) in a pipe, the present vent fan 10 can be assembled around the portions of the pipe 94. For example, a section of the pipe 94 can be removed or two smaller sections of pipe 94 can be positioned by the installer. Referring to FIG. 3, the joinable portions 92 can be positioned around the sections of the pipe 94 and assembled together with screws or other suitable fastening means, such as clips or an adhesive. Additionally, the vent fan 10 includes mounting holes 96 so the vent fan 10 can be attached to a wall or studs or other suitable structure. It should be understood by those skilled in the art that other mounting means are also contemplated. Further, if the pipe 94 is suitably secured, the vent fan 10 may not need to be fixed to any other structure besides the pipe 94. While FIG. 3 depicts the vent fan 10 in an exploded form, the vent fan may come preassembled except for the joinable portions 92. However, it should also be understood that the individual components of the vent fan 10 may not be assembled and therefore could be assembled onsite if the installation space requires.

It should also be understood by those skilled in the art that the components of the vent fan 10 may be made from a variety of materials. Specifically, the materials may include metal such as aluminum and stainless steel, plastic, composites, or other suitable materials. Additionally, the individual components may be made from different materials depending upon the function and structural requirements for the specific components.

The vent fan 10 may be used to help propel a fluid to or from a specific location as required by each individual application. For example, in one embodiment, the vent fan 10 can be located downstream from a furnace shown schematically as element 100. The vent fan 10 can be used to help draw the fluid flow from the furnace and through the vent fan. Specifically, referring to FIG. 2, the fluid enters the vent fan 10 at the inlet 20 and follows the flow path 48. After the fluid flow enters the inlet 20, the first baffle 50 blocks the fluid from entering and circulating into the outlet chamber 44. The fluid flow travels from the inlet 20 into the inlet chamber 42 where it engages the fins 62. The fins 62 aid in directing the fluid flow in a somewhat circular direction about the axis 72.

Further, the trailing edge 60 and the second baffle 52 also aids in directing the fluid flow in a circular direction about the axis 72 and towards the first passageway 46. The second baffle 52 is not merely a baffle blocking a portion of the outlet 22 and preventing the fluid flow from prematurely exiting through the outlet 22, but is curved to aid in inducing the curved, circular flow of the fluid. As the fluid flow travels in a circular direction, the flow restricter 70 and the fixed restricter plate 74 also aid in directing the fluid flow in a circular direction and towards the first passageway 46. Further, depending upon the position of the flow restricter 70, the fluid flow may be restricted from entering the first passageway 46. As the fluid flow travels in a circular direction, it will be pulled towards the first passageway 46 by the negative pressure created in the outlet chamber 44. The fluid flow travels from the inlet chamber 42 past the flow restricter 70 and the fixed restricter plate 74 into the first passageway 46 thereby allowing the fluid flow to enter the outlet chamber 44.

The fluid flow continues in a circular direction in the outlet chamber 44 as the vanes further guide and propel the fluid flow. As the fluid flow travels through the outlet chamber 44 it encounters the first baffle 50, which directs the fluid flow towards the outlet 22. Additionally, the first baffle 50 contacts the edge of the separating wall 40 to prevent the fluid flow from recirculating through the inlet chamber 42. As the fluid flow exits the outlet chamber 44 toward the outlet 22, the second baffle 52 cooperates with the separating wall 40 and the trailing edge 60 to also prevent the fluid flow from recirculating through the inlet chamber 42.

Therefore, not only does the separating wall 40 divide the flow path 48 into inlet and outlet chambers 42,44, but it also creates discrete positive and negative chambers. Specifically, as the vanes 82 rotate, the outlet chamber 44 has a negative pressure relative to the positive pressure of the inlet chamber 42. Therefore, the fluid flow travels from the higher pressure of the inlet chamber 42 towards the lower pressure of the outlet chamber 44 where the fluid flow is propelled from the vent fan 10 through the outlet 22.

In should be noted that many of the components have smooth curved surfaces to reduce drag and friction as the fluid flow travels through the vent fan 10. Specifically, the fins 62 and the trailing edge 60 are smooth and curved to reduce friction and direct the fluid flow towards the first passageway 46. Additionally, an inner surface 102 of the first passageway is also smooth and curved to reduce friction and drag. By decreasing friction and drag, the fluid flows smoothly through the vent fan 10.

The overall design and shape of the vent fan 10 allows for inline installation. Therefore, instead of having the inlet and outlet located 90 degrees relative to one another, as in many other vent fans, the present vent fan can be installed in a pre-existing pipe without much modification as the inlet and outlet are inline.

The invention claimed is:

1. A powered vent fan comprising:

an impeller with a vane that is rotated around an axis;

a housing defining an inlet, an outlet and an internal space through which a fluid moves along a flow path between the inlet and outlet;

a separating wall dividing the internal space so as to define an inlet chamber and an outlet chamber;

a first passageway communicating between the inlet chamber and the outlet chamber, the inlet spaced radially from the first passageway, the fluid in the flow path moving from the inlet radially to and through the inlet chamber towards the first passageway, axially from the inlet chamber to the first passageway, from the first passageway to the outlet chamber and to and from the outlet;

at least one fin residing in the inlet chamber and situated to intercept fluid adjacent to the inlet, and directing the fluid flow from the inlet towards the first passageway;

a first baffle surface extending transversely to the flow path and blocking passage of the fluid at the inlet into the outlet chamber; and a second baffle surface extending transversely to the flow path and blocking passage of the fluid at the outlet back into the inlet chamber.

2. The powered vent fan of claim 1 wherein the housing comprises two joinable halves.

3. The powered vent fan of claim 1 wherein the inlet and outlet are aligned along a common axis.

4. The powered vent fan of claim 1 wherein the fin extends away from the separating wall.

5. The powered vent fan of claim 1 further comprising a flow restricter operable to selectively control the flow rate of the fluid through the first passageway.

6. A powered vent fan assembly comprising:

a housing defining an inlet, an outlet and an internal space through which a fluid moves along a flow path between the inlet and outlet;

a separating wall dividing the internal space so as to define an inlet chamber and an outlet chamber;

a first passageway communicating between the inlet chamber and the outlet chamber, the fluid in the flow path moving from the inlet to and through the inlet chamber, the first passageway, the outlet chamber and the outlet;

a first baffle surface extending transversely to the flow path and blocking passage of the fluid at the inlet into the outlet chamber; and a second baffle surface extending transversely to the flow path and blocking passage of the fluid at the outlet back into the inlet chamber; and at least one condensate port on the housing for draining condensate from the vent fan.

7. A powered vent fan assembly comprising:

a housing defining an inlet, an outlet and an internal space through which a fluid moves along a flow path between the inlet and outlet;

a separating wall dividing the internal space so as to define an inlet chamber and an outlet chamber;

a first passageway communicating between the inlet chamber and the outlet chamber, the fluid in the flow path moving from the inlet to and through the inlet chamber, the first passageway, the outlet chamber and the outlet;

a first baffle surface extending transversely to the flow path and blocking passage of the fluid at the inlet into the outlet chamber;

a second baffle surface extending transversely to the flow path and blocking passage of the fluid at the outlet back into the inlet chamber; and a flow restricter operable to selectively control the flow rate of the fluid through the first passageway, wherein the flow restricter comprises a curved plate.

8. The powered vent fan assembly of claim 7 wherein the flow restricter comprises a controller located external to the housing for rotating the flow restricter about a passage axis.

9. A powered vent fan assembly comprising:

a housing having an interior and an exterior, the interior having a first internal side and a second internal side spaced substantially opposite the first internal side, the housing defining an inlet, an outlet and an internal space through which a fluid moves along a flow path between the inlet and outlet;

a separating wall dividing the internal space so as to define an inlet chamber and an outlet chamber, a first passageway communicating between the inlet chamber and the outlet chamber, the fluid in the flow path moving from the inlet to and through the inlet chamber, the first passageway, the outlet chamber and the outlet;

at least one fin residing in the inlet chamber and intercepting, and directing the fluid flow from the inlet towards the first passageway;

a first baffle surface formed as one piece with the first internal side and extending transversely to the flow path and blocking passage of the fluid at the inlet into the outlet chamber;

a second baffle surface formed as one piece with the second internal side and extending transversely to the flow path and blocking passage of the fluid at the outlet back into the inlet chamber; and a variable flow restricter that is configured to direct fluid flow in the inlet chamber in a circular direction and towards the first passageway.

10. The powered vent fan assembly of claim 9 wherein the housing comprises two joinable halves.

11. The powered vent fan assembly of claim 9 wherein the inlet and outlet are aligned along a common axis.

12. The powered vent fan assembly of claim 9 wherein the fin extends away from the separating wall.

13. The powered vent fan assembly of claim 9 wherein the flow restricter is movable around a passage axis without moving axially along the passage axis.

14. A powered vent fan assembly comprising:

a housing having an interior and an exterior, the interior having a first internal side and a second internal side spaced substantially opposite the first internal side, the housing defining an inlet, an outlet and an internal space through which a fluid moves along a flow path between the inlet and outlet;

a separating wall dividing the internal space so as to define an inlet chamber and an outlet chamber, a first passageway communicating between the inlet chamber and the outlet chamber, the fluid in the flow path moving from the inlet to and through the inlet chamber, the first passageway, the outlet chamber and the outlet;

a first baffle surface formed as one piece with the first internal side and extending transversely to the flow path and blocking passage of the fluid at the inlet into the outlet chamber;

a second baffle surface formed as one piece with the second internal side and extending transversely to the flow path and blocking passage of the fluid at the outlet back into the inlet chamber; and at least one condensate port on the housing for draining condensate from the vent fan.

15. A powered vent fan assembly comprising:

a housing having an interior and an exterior, the interior having a first internal side and a second internal side spaced substantially opposite the first internal side, the housing defining an inlet, an outlet and an internal space through which a fluid moves along a flow path between the inlet and outlet;

a separating wall dividing the internal space so as to define an inlet chamber and an outlet chamber, a first passageway communicating between the inlet chamber and the outlet chamber, the fluid in the flow path moving from the inlet to and through the inlet chamber, the first passageway, the outlet chamber and the outlet;

a first baffle surface formed as one piece with the first internal side and extending transversely to the flow path and blocking passage of the fluid at the inlet into the outlet chamber;

a second baffle surface formed as one piece with the second internal side and extending transversely to the flow path and blocking passage of the fluid at the outlet back into the inlet chamber; and a flow restricter operable to selectively control the flow rate of the fluid through the first passageway, wherein the flow restricter comprises a curved plate.

16. The powered vent fan assembly of claim 15 wherein the flow restricter comprises a controller located external to the housing for rotating the flow restricter about a passage axis.

17. A powered vent fan assembly comprising:

a housing defining an inlet for directing a fluid along a first axis into an interior of the housing, an outlet for discharging fluid from the interior of the housing substantially along the first axis and an internal space through which the fluid moves along a flow path between the inlet and outlet;

a separating wall dividing the internal space so as to define an inlet chamber and an outlet chamber;

a first passageway having a central axis and a diameter communicating between the inlet chamber and the outlet chamber;

the fluid in the flow path moving from the inlet to and through the inlet chamber, the first passageway, the outlet chamber and the outlet; and at least one fin residing in the inlet chamber and intercepting, and directing the fluid flow from the inlet towards the first passageway, the at least one fin spaced radially relative to the central axis of the first passageway a substantial distance from the diameter of the first passageway.

18. The powered vent fan assembly of claim 17 wherein the fin extends away from the separating wall.

19. The powered vent fan assembly of claim 17 wherein the fin extends away from the separating wall.

20. The powered vent fan assembly of claim 17 further comprising a flow restricter operable selectively to control the flow rate of the fluid through the first passageway, the flow moving through the first passageway along a second axis and the flow restricter has a surface facing radially relative to the second axis that blocks passage of flow from the inlet chamber into the first passageway.

21. A powered vent fan assembly comprising:

a housing defining an inlet for directing a fluid along a first axis into an interior of the housing, an outlet for discharging fluid from the interior of the housing substantially along the first axis and an internal space through which the fluid moves along a flow path between the inlet and outlet;

a separating wall dividing the internal space so as to define an inlet chamber and an outlet chamber;

a first passageway communicating between the inlet chamber and the outlet chamber;

the fluid in the flow path moving from the inlet to and through the inlet chamber, the first passageway, the outlet chamber and the outlet; and at least one condensate port on the housing for draining the condensate from the vent fan.

22. A powered vent fan assembly comprising:

a housing defining an inlet for directing a fluid along a first axis into an interior of the housing, an outlet for discharging fluid from the interior of the housing substantially along the first axis and an internal space through which the fluid moves along a flow path between the inlet and outlet;

a separating wall dividing the internal space so as to define an inlet chamber and an outlet chamber;

a first passageway having a central axis and a diameter communicating between the inlet chamber and the outlet chamber;

the fluid in the flow path moving from the inlet to and through the inlet chamber, the first passageway, the outlet chamber and the outlet; and a flow restricter operable selectively to control the flow rate of the fluid through the first passageway, wherein the flow restricter comprises a curved plate.

23. The powered vent fan assembly of claim 22 wherein the flow restricter comprises a controller located external to the housing for rotating the flow restricter about a passage axis.

24. The powered vent fan assembly of any of claims 2, 7 14, 15, 21, and 22 further comprising at least one fin residing in the inlet chamber and intercepting, and directly the fluid flow from the inlet towards the first passageway.

25. The powered vent fan assembly of any of claims 6, 7, 9, 14, 15 17, 21, and 22 further in combination with a rotatable impeller for inducing flow of fluid through the powered vent fan assembly.

* * * * *